United States Patent [19]

Lakso

[11] Patent Number: 4,957,334

[45] Date of Patent: Sep. 18, 1990

[54] INTERLOCK SYSTEM

[75] Inventor: Matthew L. Lakso, Westminister, Mass.

[73] Assignee: Priority Mfg. Corp., Leominster, Mass.

[21] Appl. No.: 265,594

[22] Filed: Nov. 1, 1988

[51] Int. Cl.[5] ..... E05C 7/06

[52] U.S. Cl. ..... 312/221; 312/219

[58] Field of Search ..... 312/216, 217, 218, 219, 312/220, 221; 292/252, DIG. 18

[56] References Cited

U.S. PATENT DOCUMENTS

| | | | |
|---|---|---|---|
| 4,272,138 | 6/1981 | Stark | 312/221 |
| 4,355,851 | 10/1982 | Slusser | 312/215 |
| 4,711,505 | 12/1987 | Lakso | 312/220 |
| 4,768,844 | 9/1988 | Ludwig | 312/221 |
| 4,770,476 | 9/1988 | Lakso | 312/221 |

*Primary Examiner*—Peter R. Brown
*Assistant Examiner*—Brian K. Green
*Attorney, Agent, or Firm*—Norman S. Blodgett; Gerry A. Blodgett

[57] ABSTRACT

An interlock system for a multi-draw cabinet having a latching module for each drawer which is actuated by the movement of the draw between an open and a closed position relative to the cabinet. Each latching module includes a base which is mounted to the side wall of the cabinet and includes an actuating lever which is pivotally mounted on the supporting base and is moved between a non-actuating position and an actuating position through an inter-connection between the lever and the drawer. An elongated transmitter extends between each adjacent latching module for relative longitudinal movement between adjacent latching modules within appropriate vertical passageways in the modules. Each latching module has a horizontal passageway which intersects the vertical passageway and which contains a horizontally-extending transmitter which is moved toward the vertical passageway by movement of the actuating lever from its non-actuating position to its actuating position upon opening of its corresponding drawer. The movement of the horizontal transmitter engages the end of the corresponding vertical transmitter and displaces it along its vertical longitudinal axis so that the opposite end of the vertical transmitter is misaligned with the horizontal transmitter of the adjacent latching module and prevents the actuating lever of the adjacent latching module from moving to its actuating position and thereby preventing its corresponding drawer from opening.

13 Claims, 7 Drawing Sheets

Fig. 2
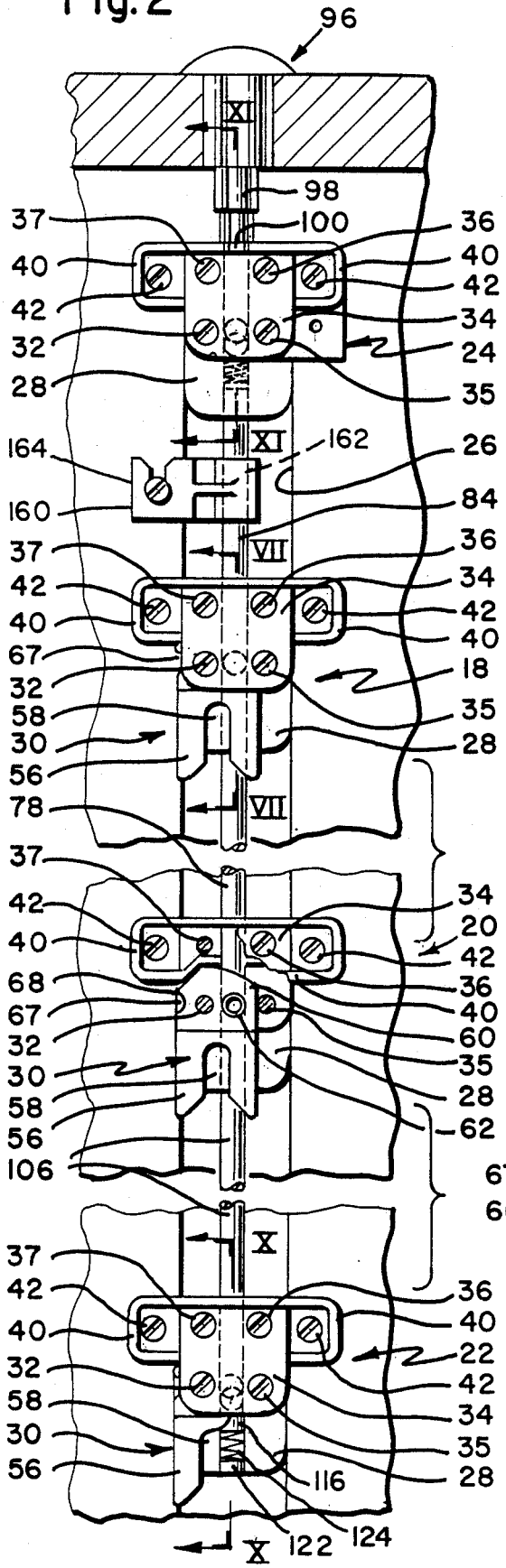
Fig. 3
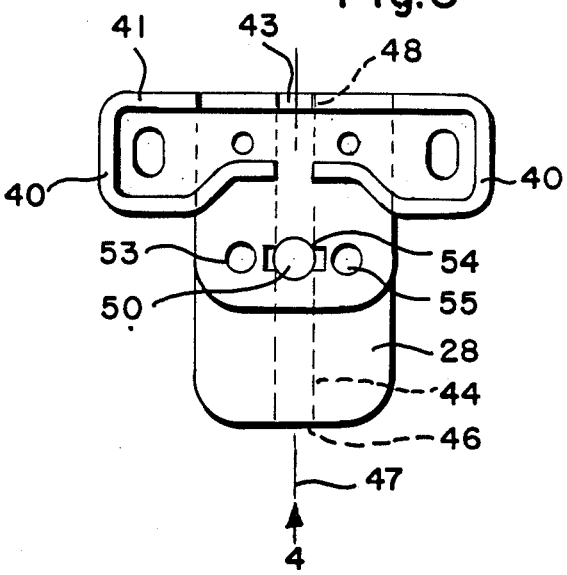
Fig. 4
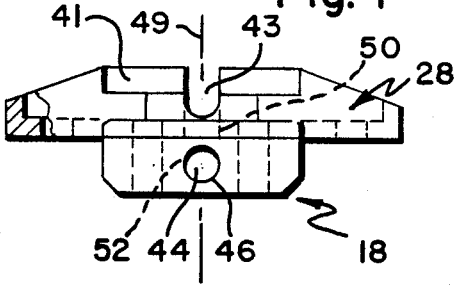
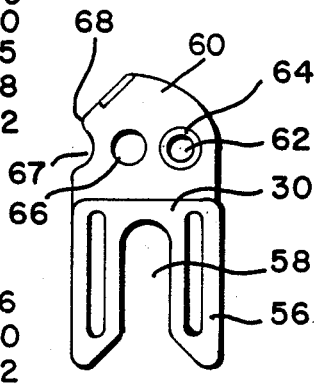
Fig. 5
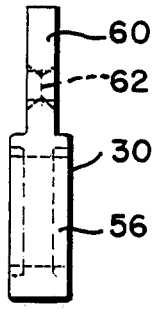
Fig. 6

Fig. 7
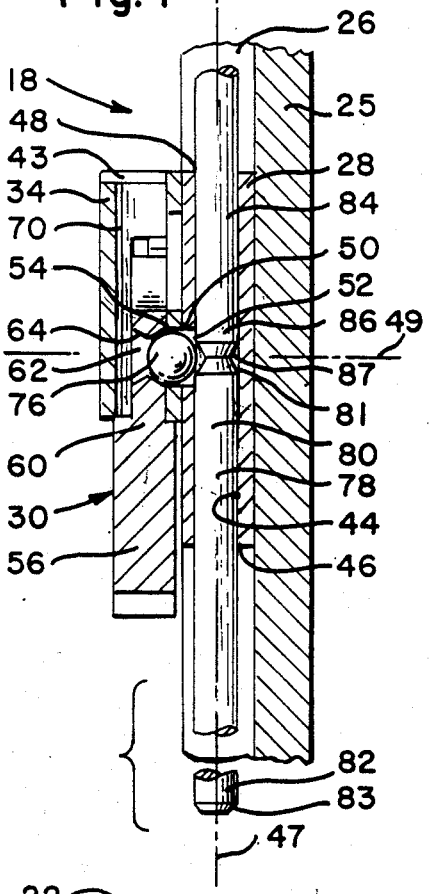
Fig. 8
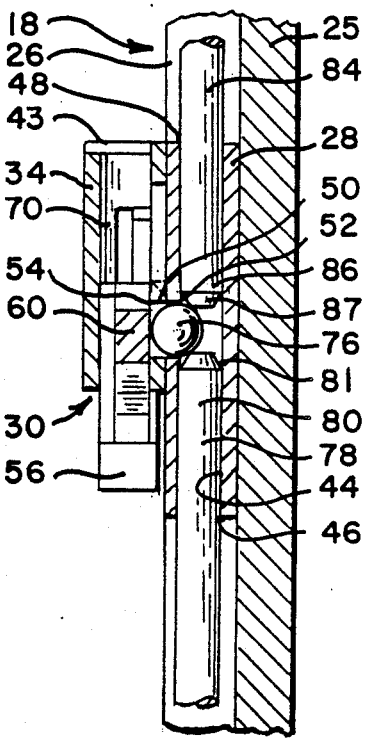
Fig. 9
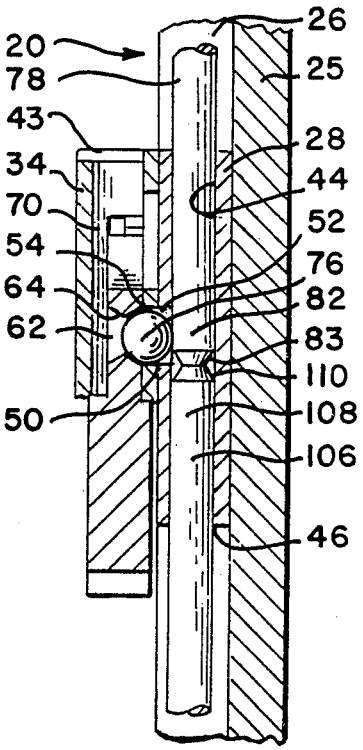
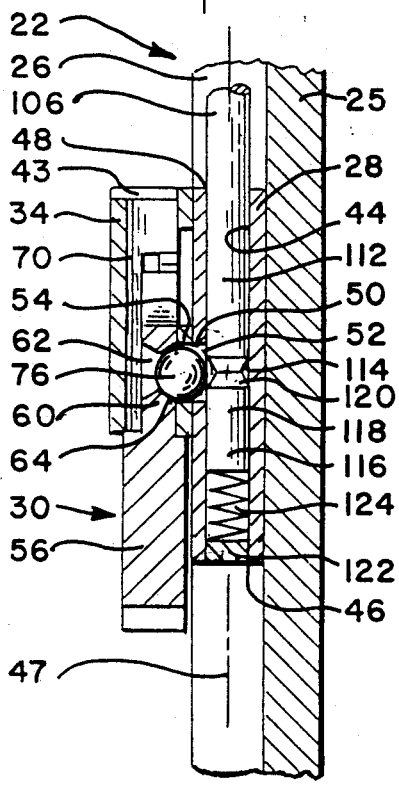
Fig. 10
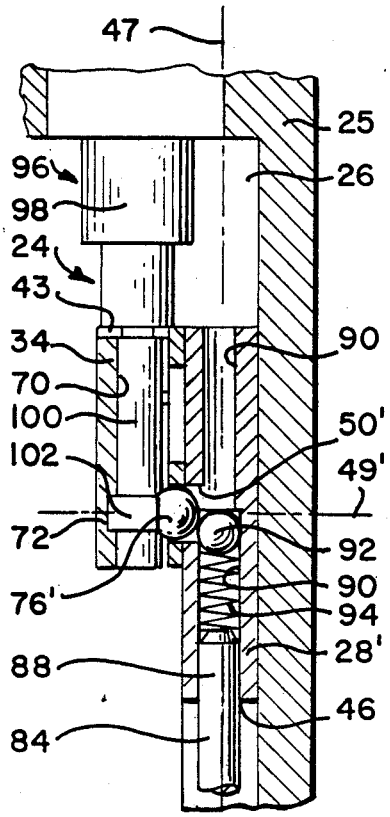
Fig. 11
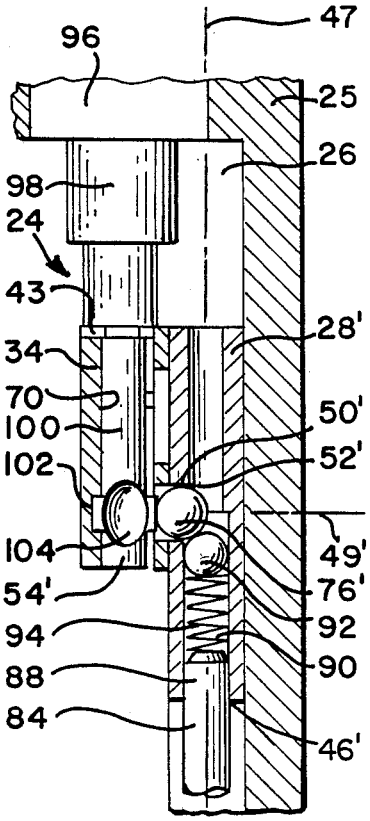
Fig. 12

Fig.13
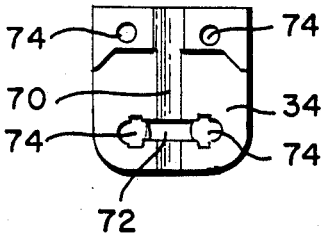
Fig.14
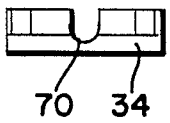
Fig.15
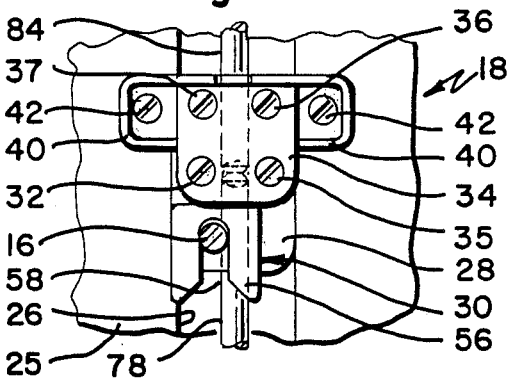
Fig.16
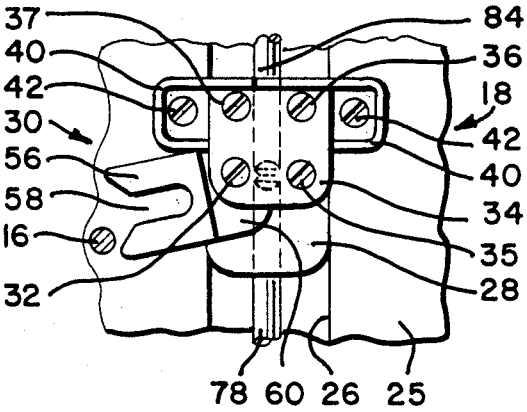
Fig.17
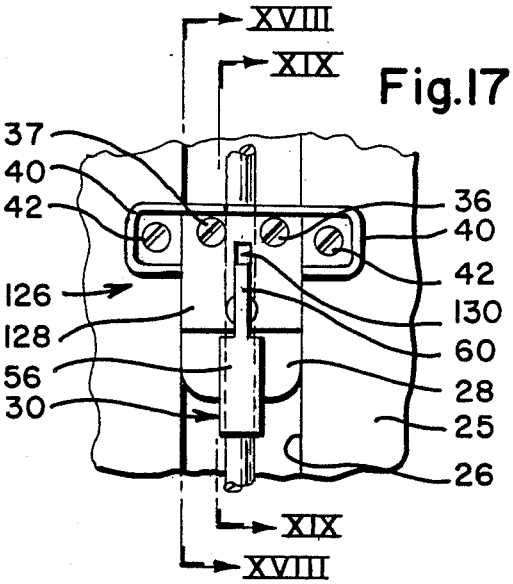
Fig.18
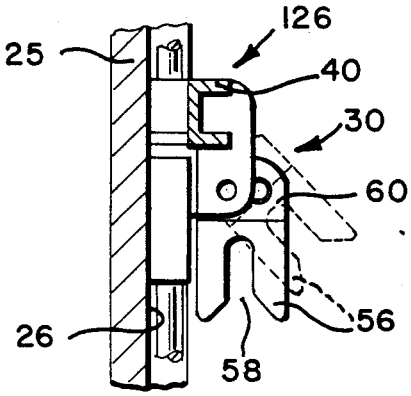
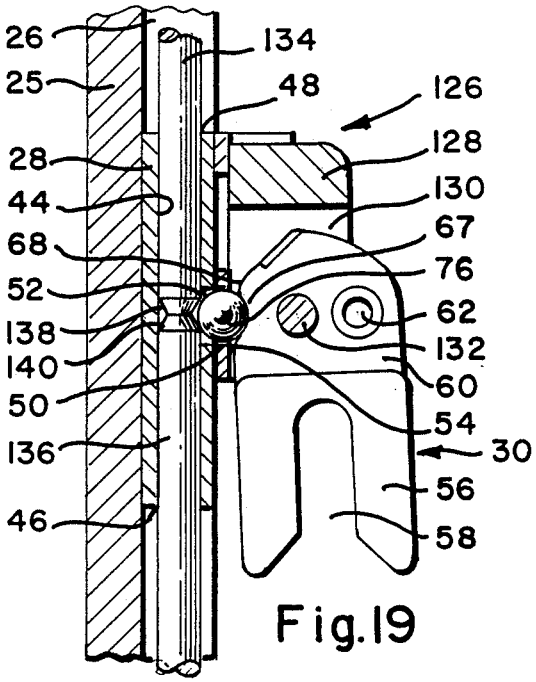
Fig.19

INTERLOCK SYSTEM

BACKGROUND OF THE INVENTION

The present invention relates generally to an interlock system for multi-drawer cabinets and specifically to an interlock system in which one of the drawers is in the open position, none of the remaining drawers can be moved to the open position.

The primary reason for preventing the opening of more than one drawer of the multi-draw cabinet at any one time, is to prevent the cabinet from tipping over due to an unbalanced condition which is created by the weight of material in two or more open drawers. When two or more drawers are fully opened at the same time, the weight of the material in the drawers causes the center of gravity of the cabinet to shift forwardly. If the center of gravity is forward of the base of the cabinet, the cabinet tips forwardly toward the individual who is working with the cabinet. This condition can cause serious injury to the individual. Many types of interlock systems have been suggested in the past. However, these devices have not been completely satisfactory with respect to operation, costs, and objectionable noise. My prior U.S. Pat. No. 4,711,505 represents a substantial improvement in the art of interlocking systems for cabinets. There is a latching module which is associated with each drawer of the cabinet. A line of discreet elements such as balls extend between adjacent modules which are guided in a track that extends between the adjacent modules. The balls are aligned so that an actuator ball impinges between two adjacent discreet elements or balls in the track. When a drawer is opened, an actuator which is associated with the drawer causes the actuator ball to move between two of the discreet elements in the track and displace the discreet elements along the axis of the track. This displacement shifts the alignment of the discreet elements with respect to other actuator balls so that each of the other actuator balls impinges directly on a discreet element rather than between two adjacent discreet elements in the track. Although this system offers many advantages over other prior art devices with respect to operation and versatility, there are certain objectionable characteristics. For example, the string of discreet elements which extend between two actuators must be confined and guided and they require precise positioning in order for the system to function properly. These and other difficulties experienced with the prior art interlock devices have been obviated by the present invention.

It is, therefore, a principle object of the invention to provide an interlock system for multi-draw cabinets which includes a latching module for each draw and a single rigid connector between adjacent modules which does not require guides and tracks between adjacent modules.

Another object of this invention is the provision of an interlock system for multi-draw cabinets which includes a latching module for each drawer and a single locking module which operates in conjunction with the latching modules for preventing the opening of all drawers of the cabinet when the locking module is in the locked position.

A further object of the present invention is the provision of an interlock system for multi-draw cabinets which utilizes a latching module for each drawer in which each module is made up of several components which can be combined in a plurality of ways to vary the function of the module, such as left and right hand operation.

It is another object of the present invention to provide an interlock system for a multi-draw cabinet which utilizes a plurality of latching modules in a locking module wherein each module comprises several components and at least some of the components of the latching module are interchangeable with at least some of the components of the locking module.

A still further object of the invention is the provision of an interlock system for multi-draw cabinets which is adaptable to a wide range of cabinets while utilizing relatively few basic components.

It is a further object of the invention to provide an interlock system for a multi-drawer cabinet which comprises relatively few basic components which are relatively simple in construction and relatively easy to install in a cabinet.

With these and other objects in view, as will be apparent to those skilled in the art, the invention resides in the combination of parts set forth in the specification and covered by the claims appended hereto.

SUMMARY OF THE INVENTION

In general, the invention consists of an interlock system for a multi-drawer cabinet having a latching module for each drawer, the latching modules being operatively interconnected so that if one drawer is opened the remaining drawers are prevented from being opened. An elongated transmitter extends from one latching module to its adjacent latching module along an axis which extends through all of the latching modules. Each latching module includes a second transmitter which is movable along an axis which is transverse to the first axis for engaging the end of the first transmitter and shifting the first transmitter along the first axis when its corresponding drawer is opened so that the shifting of the first transmitter along the first axis changes the alignment of the opposite end of the first transmitter with respect to the second transmitter of the adjacent latching module and preventing movement of the second transmitter of the adjacent latching module from moving towards the first axis and preventing its associated drawer from opening.

BRIEF DESCRIPTION OF THE DRAWINGS

The character of the invention, however, may be best understood by reference to one of its structural forms, as illustrated by the accompanying drawings, in which:

FIG. 2 is a fragmentary elevational view of one side wall of the cabinet and showing the interlock system of the present invention, FIG. 3 is a front elevational view of the base component of each of the latching modules shown in FIG. 2, FIG. 4 is a bottom plan view of the base component of FIG. 3, FIG. 5 is a front elevational view of an actuating lever which forms part of each of the latching modules shown in FIG. 2, FIG. 6 is a side elevational view of the actuating lever looking in the direction of arrowr VI of FIG. 5, FIG. 7 is a vertical cross-sectional view of one of the latching module taken along line VII—VII of FIG. 2 and looking in the direction of the arrows, FIG. 8 is a view similar to FIG. 7, showing the condition of the latching module when its corresponding drawer is open, FIG. 9 is a view similar to FIG. 7, showing the configuration of one of the latching module when a drawer which corresponds to one of the other latching modules is open, FIG. 10 is a vertical cross-sectional view taken along the line X—X of FIG. 2 and looking in the direction of the arrows, showing the lowermost or end module of the series of latching modules shown in FIG. 2, FIG. 11 is a vertical cross-sectional view taken along line XI—XI of FIG. 2 and looking in the direction of the arrows of the locking module at the upper end of the series of latching modules shown in FIG. 2 and showing the locking module in the unlocked state, FIG. 12 is a view similar to FIG. 11, showing the locking module in the locked state, FIG. 13 is a rear elevational view of a cover plate which is a component of each of the latching and locking module of FIG. 2, FIG. 14 is a top plan view of the cover plate of FIG. 13, FIG. 15 is a fragmentary front elevational view of one of the latching modules of FIG. 2, shown in operative engagement with a transfer element from its corresponding drawer when the drawer is in the closed condition, FIG. 16 is similar to FIG. 15 showing the position of the transfer element relative to the latching module when the corresponding drawer is in the open condition, FIG. 17 is a front elevational view of a modified latching module for use at the back wall of a cabinet and which incorporates many of the components of the latching module shown in FIG. 2, FIG. 18 is a vertical cross-sectional view taken along the line XVIII—XVIII of FIG. 17 and looking in the direction of the arrows, FIG. 19 is a vertical cross-sectional view taken along the line XIX—XIX of FIG. 17 and looking in the direction of the arrows.

DESCRIPTION OF THE PREFERRED EMBODIMENT

Figure 1:
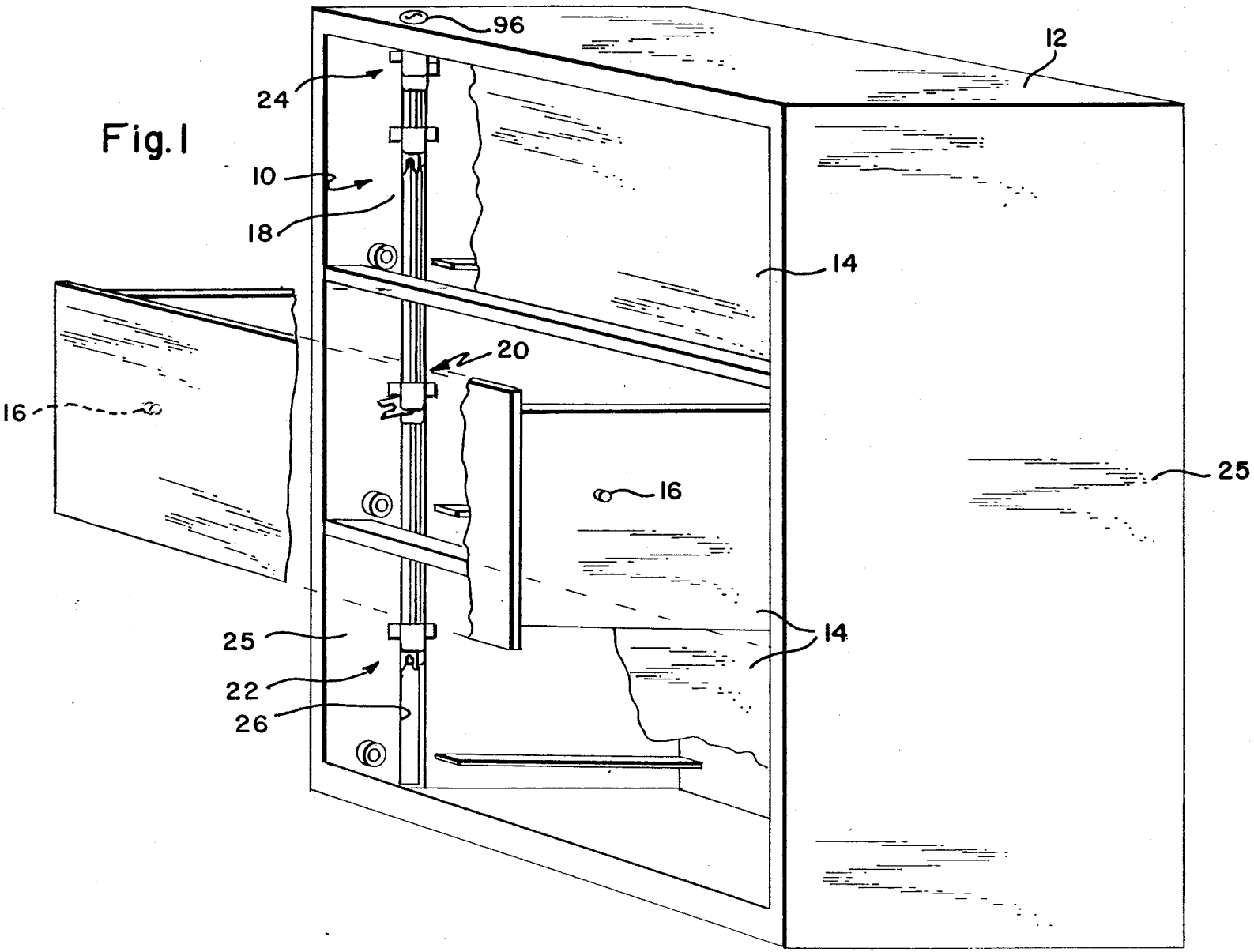
FIG. 1 is a perspective view with portions cut away of a conventional multi-draw file cabinet which incorporates the interlock system of the present invention.

Referring first to FIGS. 1 and 2, which show the general features of the invention, the interlock system of the present invention is generally indicated by the reference numeral 10 and is shown in FIG. 1 as applied to a three-drawer cabinet 12 having drawers 14. A transfer element in the form of a pin 16 is fixed to and extends outwardly from the side of each drawer 14 as can be seen in the middle drawer 14 in FIG. 1. The transfer pins 16 interact with latching modules described below. The interlock system 10 comprises a plurality of latching modules 18, 20 and 22 and a locking module 24 which are arranged in a vertical series within a groove 26 in the inner surface of each side wall 25 of the cabinet. Each of the latching modules 18, 20, 22, comprises a supporting base portion 28, an actuating lever 30 which is pivotally mounted to the base 28 by means of a screw 32, and a cover 34 which is mounted to the base 28 by means of the screw 32 and screws 35, 36, and 37. The actuating lever 30 differs between the supporting base 28 and the cover 34. The supporting base 28 has a pair of laterally-extending flanges 40 which extend beyond the vertical groove 26 and which enable the supporting base to be fastened to the side wall 25 by means of screws 42.

Referring also to FIGS. 3 and 4, the supporting base 28 includes a vertical passageway 44 which has a vertical longitudinal axis 47, a first end opening 46, and a second end opening 48. A second horizontal passageway 50 has a second longitudinal horizontal axis 49 which intersects the axis 47. The passageway 50 has an inner opening 52 and an outer opening 54 and intersects the passageway 44 as shown for example in FIGS. 7 and 8. The supporting base 28 also has a top wall 41 which is provided with an elongated central notch 43 for a purpose to be described. The base 34 has a threaded hole 53 for receiving the screw 32 and a threaded hole 55 for receiving the screw 35.

Referring also to FIGS. 5 and 6, the actuating lever 30 is a bell crank lever having a first arm 56 and a second arm 60. The first arm 56 extends freely from the supporting base 28 and has an open ended slot 58. The second arm 60 lies between the cover 34 and the supporting base 28. The actuating lever 30 has an opening 62 and a beveled cam surface 64 at the edge of the opening 62. A hole 66 extends through the lever 58 and a space from the hole 62 for receiving the fastener 32. The rounded indentation 67 and a rounded protrusion 68 are located at one side edge of the lever 30 for use with respect to a modified latching module to be described.

Referring to FIGS. 13 and 14, the rear side of the cover has a vertical groove 70 and a horizontal groove 72 which intersects the groove 70 and is slightly deeper than the groove 70. The cover 34 also has a plurality of apertures 74 for receiving the screws 32, 35, 36, and 37. There is a latching module for each drawer of the cabinet at each side of the cabinet. Each latching module is positioned with respect to its respective drawer so that the corresponding adjacent pin 16 extends into the slot 58 of the arm 56 when its corresponding drawer is in the closed position as shown in FIG. 15. When the drawer is moved to the open position, the pin 16 causes the arm 56 to rotate about the fastener 32 towards the front of the drawer to the actuating position shown in FIG. 16. Thereafter, the pin 16 leaves the slot 58 through the opening at the end of the slot as shown in FIG. 16, see also the latching module 20 shown in FIG. 1. The top and bottom drawers 14 of the cabinet 12 are shown in the closed position in FIG. 1 so that their corresponding latching modules 18 and 22, respectively, are in the non-actuating position.

Referring particularly to FIGS. 2, 15, 16, 7 and 8, a first transmitter, in the form of a ball 76, is located in the second passageway 50 of latching module 18. The ball 76 is also located in the opening 62 of the lever 30 as shown more clearly in FIG. 7 when the latching module 18 is in the non-actuating condition as shown in FIGS. 2 and 15. A second transmitter, in the form of an elongaged cylindrical rod 78, is located in the first passageway 44 for sliding along the axis 47. The rod 78 has a first end 80 which has an annular beveled surface 81 and a second end 82 which has an annular beveled surface 83. The surface 81 is at an acute angle to the vertical axis 47 and the horizontal axis 49. A third transmitter, in the form of an elongated cylindrical rod 84, is also located in the first passageway 44 for sliding along the axis 47. The rod 84 has a first end 86 which has an annular beveled surface 87 and a second end 88. The beveled surface 87 is also at an acute angle to the vertical axis 47 and to the horizontal axis 49. The first ends 80 and 86 of rods 78, 84 respectively, abut at the horizontal axis 49 so that the beveled surfaces 81 and 87 are aligned with the end opening 52 of the second passageway 50 and the ball 76 as shown in FIG. 7. The rods 78 and 84 are biased towards each other by biasing means to be described so that they normally abut at the position shown in FIG. 7. When the drawer which corresponds to the latching module 18 is opened, the corresponding pin 16 causes the lever 30 to move from its non-actuating position shown in FIG. 15 to its actuating position shown in FIG. 16. This movement causes the ball 76 to be forced toward the beveled surfaces 81 and 87 and into the passageway 44, thereby displacing the ends 81 and 86 of rods 78 and 84, respectively, away from each other along the vertical axis 47 as shown in FIG. 8. The downward movement of the rod 78 causes the beveled surface 83 at its second end 82 to move out of alignment with the second passageway 50 of the latching model 20 as shown in FIG. 9. The ball 76 of the latching module 20 is thereby prevented from moving into the first passageway 44 of the module 20 by the rod 78. This prevents the actuating lever 30 of the latching module 20 from moving from its non-actuating position to its actuating position and, thereby, preventing its corresponding drawer from being opened. The rods for each latching module extend along the vertical axis 47. When all of the drawers 14 are closed, the ends of each pair of rods in the module abut so that their respective beveled surfaces are aligned with their respective passageway 50 of the latching model as shown in FIG. 7. When one of the drawers is opened so that two of the rods are displaced in opposite directions as shown in FIG. 8, the rods for all other latching modules are displaced to the extent shown in FIG. 9 so that no other drawer can be opened, regardless of how many drawers there are in the cabinet.

Referring particularly to FIGS. 11 and 12, the locking module 24 has at least one of the basic components of the latching modules 18, 20 and 22, such as the cover 34. A supporting base 28 is identical to base 28 except that the upper portion of the first vertical passageway has a reduced diameter. However, the locking module 24 does not have an actuating lever 30. The locking module 24 has a first vertical passageway, indicated by the reference numeral 90, which extends along the axis 47. The passageway 90 has a reduced diameter above its second horizontal passageway 50'. A ball 92 is slidably mounted in the lower portion of the passageway 90 along the axis 47 but is prevented from moving upwardly beyond the horizontal axis 49' of the passageway 50', by the reduced diameter portion of the passageway as shown in FIG. 11. The elongaged rod 84 which extends upwardly from the latching module 18 has a second end 88 which extends into the first passageway 90 through the first opening 46'. The helical compression spring 94 is located between the end 88 of the rod 84 and the ball 92 for maintaining the ball 92 in its upper position as shown in FIG. 11. The spring 94 also biases the rod 84 downwardly and thereby constitutes part of the biasing means for all of the rods along the axis 47. A first transmitter in the form of a ball 76' is located in the second passageway 50'. The ball 76' is moved along the axis 49' by means of an actuator which is in the form of a key actuated lock, generally indicated by the reference numeral 96. The lock 96 is fixed in the top wall of the cabinet 12 as shown in FIG. 1. The lock 96 includes a cylinder 98 which is rotated by the key and a shaft 100 which extends downwardly from the cylinder 98. The shaft 100 extends through the notch 43 and lies along the vertical groove 70 of the cover 34 so that it is rotatable about its central longitudinal axis between the cover 34 and the supporting base 28'. The lower end of the shaft 100 has a cam surface 102 which extends beyond the outer surface of the shaft 100 and a depression 104 which extends inwardly from the outer surface of the shaft 100. The ball 76' normally seats into the depression 104 as shown in FIG. 11 when the lock 96 is in the unlocked condition. When the lock 96 is actuated to the locked condition, the cylinder 98 and the shaft 100 are rotated 90° about their common central longitudinal axis to the position shown in FIG. 12. When the shaft 100 is rotated to the locked position, the depression 104 moves away from the ball 76' and the cam surface 102 engages the ball 76' and pushes it partially through the inner opening 62' of the second passageway 50' toward the axis 47 and into the passageway 90 to the position shown in FIG. 12. The movement of the ball 76' towards the axis 47 displaces the ball 92 downwardly and compresses the spring 94 which, in turn, biases the rod 84 downwardly to mis-align all of the abutting ends of the rods in each latching module with respect to the second passageway 50 of each latching module. This prevents all of the drawers of the cabinet from being opened. However, the locking module 24 is not affected by the opening of any drawer when the locking module is in the unlocked condition since the ball 92 is prevented from moving upwardly beyond the horizontal axis 49'. When the rod 84 is displaced upwardly, as the result of the opening of one of the drawers, the spring 94 is compressed. The lock 96 can still be locked even if one of the drawers is opened. The downward displacement of the ball 92 further compresses the spring 94. When the drawer is thereafter closed, the rod 84 is free to move downwardly so that the abutting ends of the rods for each latching module are misaligned with their respective second passageway 50, as shown in FIG. 9. This is commonly referred to in the trade as a slam-lock feature.

Referring to FIGS. 9 and 10, a fourth transmitter, in the form of the rod 106, is located in the first passageway of the latching module 20 and has a first end 108 which abuts the end 82 of the rod 78. The end 108 has a annular beveled surface 110 which is engaged by the ball 76 when the latching module 20 is actuated and the beveled surfaces 83 and 110 are aligned with the passageway 50 of the latching module 20. The rod 106 extends downwardly through the second opening 48 and into the first passageway 44 of the lower-most end latching module 22. The lower end 112 of the rod 106 has an annular beveled surface 114 which is positioned at the inner opening 52 of the horizontal passageway 50 of the lower-most module 22. A fifth transmitter, in the form of an elongated rod 116, is also positioned within the passageway 44 of the module 22 for sliding motion along the vertical axis 47 below the elongated rod 106.

The rod 116 has an upper end 118 which abuts the lower end 112 of the rod 106 and a annular beveled surface 120 which is located at the inner opening 52 of the passageway 50. The first or bottom opening 46 of the passageway 44 contains a stop 122. A helical compression spring 124 is located between the stop 122 and the bottom end of the rod 116 for urging the rod 116 toward the rod 106. The spring 124 forms part of the biasing means together with the spring 94 for normally maintaining the abutting ends of transmitter rods for each of the latching modules in alignment with their respective transmitter balls 76, as shown for example, in FIGS. 7 and 10. When the rod 106 is moved downwardly by the displacing action of the module 20, when its corresponding drawer is opened, the lower beveled surface 114 of the rod 106 and the upper beveled surface 120 of the rod 116 are displaced below the opening 52 of the latching module 22, thereby preventing the latching module 22 from being actuated and preventing its corresponding drawer from being opened.

Referring particularly to FIG. 1, the latching modules 18, 20, and 22 are located at the left side of the cabinet and thereby function as left-handed latching modules. The latching modules at the right side of the cabinet which are not shown in FIG. 1, have a right-handed orientation. However, the latching modules at the right side of the cabinet have the same basic components as the latching modules at the left side of the cabinet. Each latching module can be converted from a left-handed orientation to a right-handed orientation by changing the position of the actuating lever with respect to the base 28 and the cover 34. The rear surface of the actuating lever 30 is a mirror image of the front surface of the lever which is illustrated in FIG. 5. The latching module is converted from a left-hand module to a right-hand module by removing the screws 32, 35, 36 and 37 and the cover 34. The actuating lever is also removed from the module rotated 180° about its vertical longitudinal axis, and repositioned in the module so that the hole 66 is aligned with the hole 55 of the supporting base 28. When the cover 34 is remounted to the supporting base by means of the fasteners 32, 35, 36, and 37, the fastener 35 extends through the hole 66 of the lever 30 and the hole 55 of the base 34 so that the lever 30 pivots about the fastener 35. The ball 76 is aligned with the hole 62 in the same manner as when the lever 30 is pivoted about the fastener 32. This eliminates the need for separate left and right-handed latching modules and is an example of the versatility of the latching module of the present invention. The modified latching module which is illustrated in FIGS. 17–19 is another example of the versatility of the latching module of the present invention. In some cabinets, latching modules are arranged along the back wall of the cabinet requiring rearward oriented latching modules, such as the module which is illustrated in FIGS. 17–19 and generally indicated by the reference numeral 126. Latching module 126 includes some of the basic components of the latching module 18, such as the supporting base 28, actuating lever 30, and the first transmitter or ball 76. The cover 34 is replaced by a modified cover 128 which includes a vertical slot 130. The lever 30 is mounted within the slot 130 for pivoting motion about a shaft 132 which extends through the hole 66 of the actuating lever. When the actuating lever 30 is in its normal non-actuating position, the ball 76 lies in the rounded indentation 67 of the lever, as shown in FIG. 19. When the lever 30 is moved from its non-actuating position (shown in full lines in FIG. 18) to its actuating position (shown in dotted lines in FIG. 18), the ball 76 is engaged by the cam surface 68 and pushed toward the opening 52 of the passageway 50. This causes displacement of the abutting ends of a pair of rods 134 and 136. The rods 134 and 136 have respective beveled surfaces 138 and 140, respectively, which are normally in alignment with the opening 52 of the passageway 50 as shown in FIG. 19.

Figure 21:
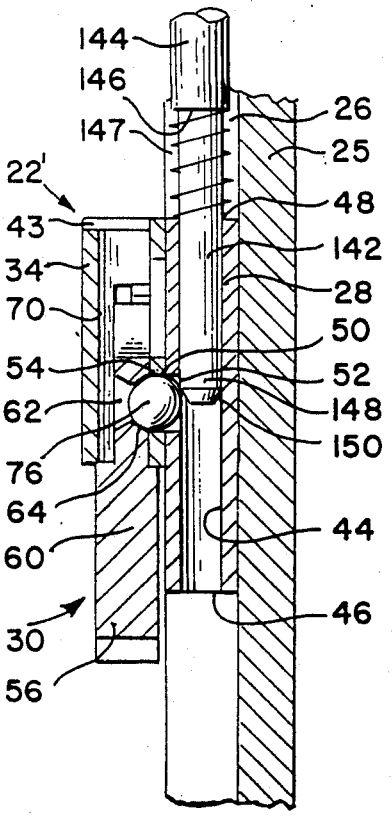
FIG. 21 is a vertical cross-sectional view of the latching module of FIG. 20.
Figure 20:
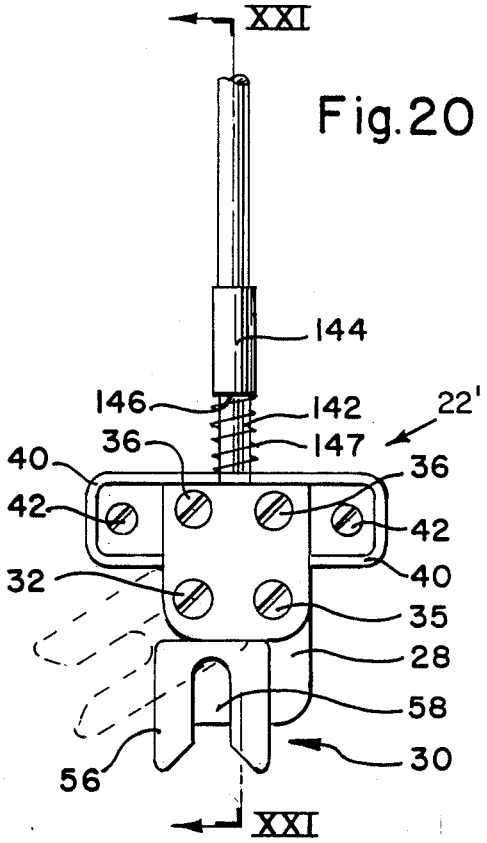
FIG. 20 is a front elevational view of a modified latching module.
Figure 22:
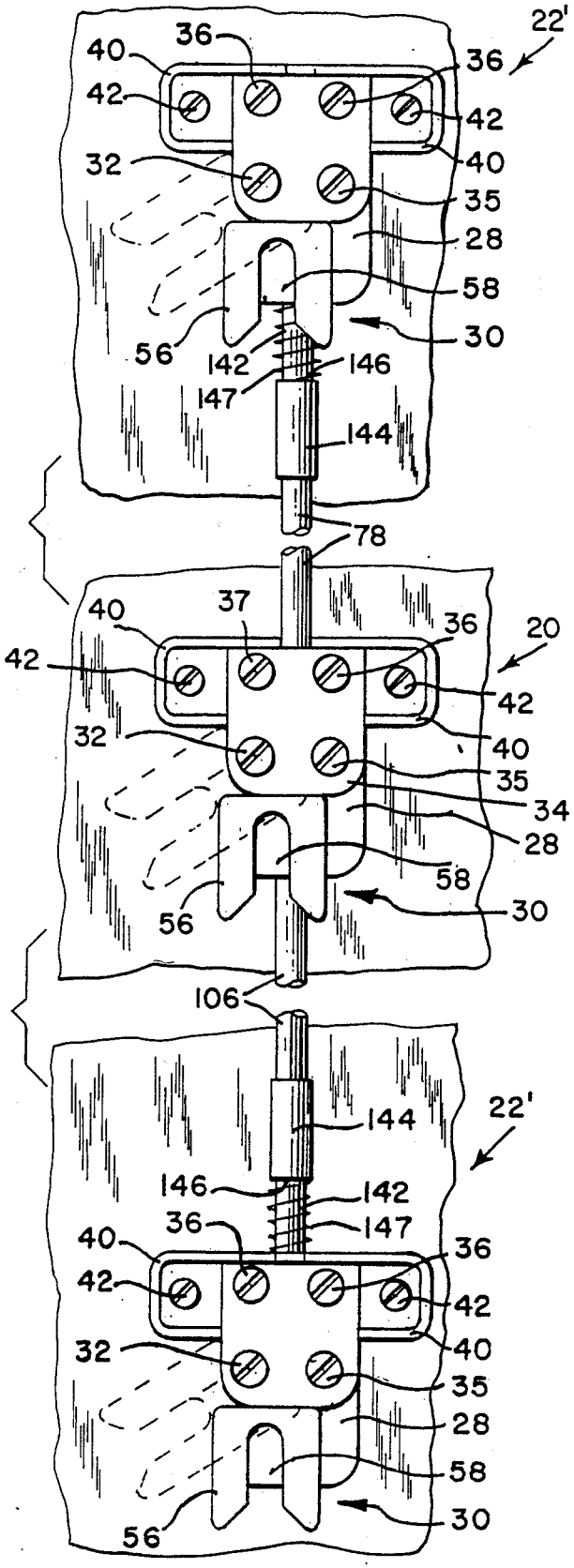
FIG. 22 is a fragmentary view which is similar to FIG. 2 in which no locking module is used and the modified end latchng module of FIGS. 20 to 21 is used as the end module at each end of the series of modules.
Figure 23:
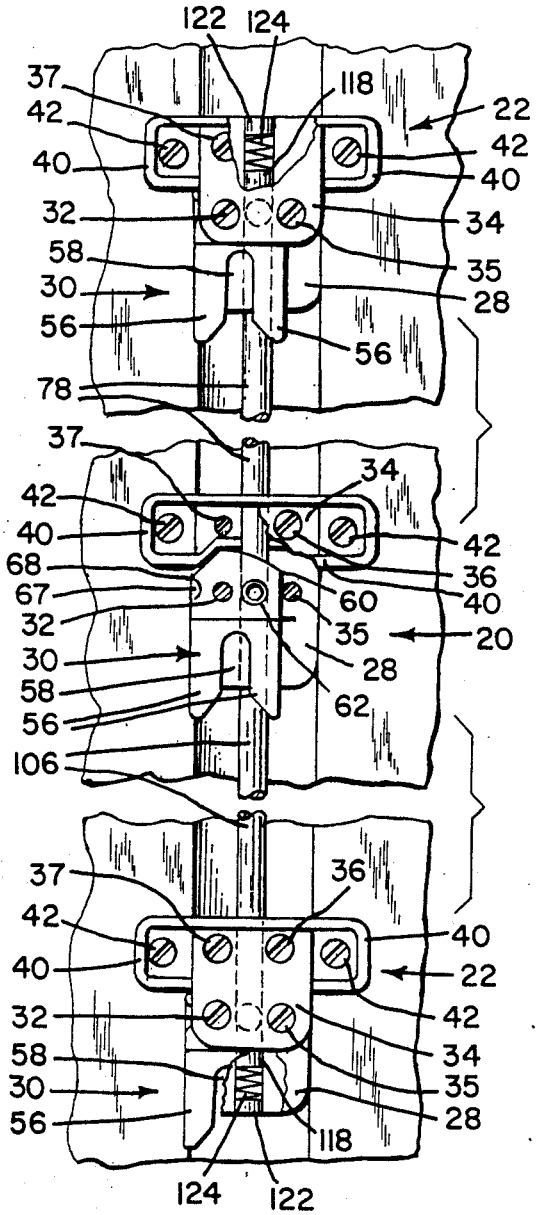
FIG. 23 is a fragmentary view which is similar to FIGS. 2 and 22 in which no locking module is used and the end latching module of FIG. 2 is used as the end module at each end of the series of modules.

Referring to FIGS. 20 and 21, there is shown a modified lower-most end latching module, generally indicated by the reference numeral 22', which is identical to the latching module 22 in that it consists of the identical components of a supporting base 28 an actuating lever 30, a cover 34, and a first transmitter in the form of ball 76 which is located within the second passageway 50 of the supporting base 28. The difference between the latching module 22' and the latching module 22 is that there is no fifth transmitter in the passageway 44 and the fourth transmitter or rod 106 which extends downwardly from the latching module 20 is replaced by a rod 142. An intermediate portion of the rod 142 has an enlarged diameter portion 144 which forms a downwardly facing shoulder 146 with respect to the lower end of the rod. A helical compression spring 147 is located between the opening 48 to the passageway 44 and the shoulder 146 for biasing the rod 142 upwardly and constitutes part of the biasing means in place of the spring 124 of the latching module 22. The rod 142 has a lower end 148 which has an annular beveled surface 150 which is in alignment with the inner opening 52 of the passageway 50, as shown in FIG. 21. When the rod 142 is displaced downwardly as a result of the opening of any of the drawers above or actuation of the locking module, the bevel surface 150 is moved out of alignment with the opening 52. This prevents actuation of the actuating lever 30 and, thereby, prevents opening of the lower-most drawer of the cabinet. The latching module 22' can also be used as the upper-most end latching module in a series of latching modules where no locking module is utilized FIG. 22. In such a case, the rod 142 extends upwardly through the bottom opening 46 into the passageway 44 and the spring 147 is located below the opening 46. The same arrangement which is shown in FIG. 21 can also be utilized as the locking module where the locking module is located above all of the latching modules. In such a case, the actuating lever 30 is replaced by the shaft 100 of the lock in the same manner as for the locking module 24. However, the rod 84, spring 94, and ball 92 are replaced by the rod 142 and the spring 147. Also, the supporting base 28 is utilized instead of the modified supporting base 28'. In such an arrangement, all of the latching modules and locking module utilize the same supporting base 28, the same cover 34, and the same first transmitter of ball 76. This arrangement does not provide a slam-lock feature but provides added versatility for the components which make up the latching and locking modules. When no locking module is used, it is replaced by an end module 22, as shown in FIG. 23.

The transmitter rods are sufficiently rigid to extend unsupported and unguided between latching modules. However, if the distance between two latching modules is unusually great, a guide clip can be used to maintain axial stability of the transmitter rod. Such a guide clip is shown, for example, in FIG. 2 and identified by the reference numeral 160. Clip 160 has a bore 162 and is attached to the side wall of the cabinet by a screw 164.

The transmitter rod extends freely through the bore 160.

Clearly, minor changes may be made in the form and construction of this invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. An interlock system for a cabinet having a plurality of drawers which are each movable ralative to the cabinet between an open position and a closed position, said locking system comprising:

(a) a latching module for each of said drawers which are arranged in a vertical series in the cabinet, each of said latching modules having:

(1) a supporting base which is fixed to the cabinet, (2) a first passageway which has a first vertical axis and which has an opening facing each adjacent latching module, (3) a second passageway which intersects said first passageway and which has a second longitudinal axis which is transverse to said first longitudinal axis, said second passageway having an inner opening at said first passageway and an outer opening, and (4) a first transmitter which is positioned in said second passageway for movement along said second axis, said first transmitter having a first end which has a first end surface at the inner opening of said second passageway and an opposite second end which has a second end surface at the outer opening of said second passageway, said first end surface being at an acute angle to said second axis and to said first axis, (b) a plurality of vertical elongated second transmitters, each of said second transmitters having an upper end which is slidable in the first passageway of the upper one of two adjacent latching modules and a lower end which is slidable in the first passageway of the lower one of said two adjacent latching modules, said upper end having an upper end surface which is at an acute angle to said first axis and to the second axis of the upper one of said two adjacent latching modules, said lower end surface lying at the inner opening of the second passageway of the upper one of said two adjacent latching modules, said lower end having a lower end surface which is at an acute angle to said first axis and to the second axis of the lower one of said two adjacent latching modules, said lower end surface lying at the inner opening of the second passageway of the lower one of said two adjacent latching modules, (c) biasing means for urging said second transmitters upwardly and downwardly so that for each two adjacent second transmitters, the lower end of the upper of said two adjacent second transmitter abuts the upper end of the lower of said two adjacent second transmitters for yieldably maintaining the upper and lower end surfaces of the respective upper and lower second transmitters of said two adjacent second transmitters at the inner opening of the second passageway of the latching module within which said two adjacent second transmitters meet, (d) an actuating lever for each of said latching modules which is pivotally mounted on the supporting base for movement between a non-actuating position and an actuating position, said actuating lever being effective to engage the second end of the corresponding first transmitter and to move the corresponding first transmitter along the second axis of its respective second passageway toward said first axis for engaging each top and bottom end surface which is at the inner opening of the latching module and for displacing each second transmitter which corresponds to an end surface which is engaged by the first transmitter along said first axis toward the adjacent latching module into which said displaced second transmitter extends so that said displaced second transmitter blocks the inner opening of the second passageway of said adjacent latching module, thereby preventing the first transmitter of said adjacent latching module from moving toward said first axis and for preventing the corresponding actuating lever of said adjacent latching module from moving to its actuating position, and (e) a transfer element for each drawer, each transfer element being fixed to its corresponding drawer, and being operatively connected to the actuating lever for its corresponding latching module for moving the corresponding actuating lever from its non-actuating position to its actuating position upon movement of the drawer from its closed position to its open position, provided that the corresponding actuating lever is not prevented from moving toward its actuating position, so that when one drawer of said cabinet is in the open position, the other drawers are prevented from being opened.

2. An interlock system for a cabinet as recited in claim 1, wherein the first transmitter for each latching module is a ball.

3. An interlock system for a cabinet as recited in claim 1, wherein the second transmitter is cylindrical and each of said first and second end surfaces is an annular bevel.

4. An interlock system for a cabinet as recited in claim 1, wherein the transfer element for each drawer is a finger which has a central longitudinal axis and which is fixed to the drawer, said finger extending laterally from the path of movement of the drawer and, wherein the actuating lever for each drawer comprises:

(a) a first arm which extends beyond the base and which has an open ended slot for receiving the finger of its corresponding drawer, said slot being transverse to the longitudinal axis of its corresponding finger, and (b) a second arm which has a cam surface for engaging the second end surface of its corresponding first transmitter and forcing the first transmitter along its second longitudinal axis toward said first axis when the lever moves from its non-actuating position to its actuating position.

5. An interlock system as recited in claim 4, wherein the first transmitter for each latching module is a ball and the second arm has a cavity for receiving the ball when the actuating lever is in its non-actuating position so that the ball is partially outside of the outer opening of its corresponding second passageway and outside of the inner opening of the second passageway, said cam surface being located at the periphery of said cavity.

6. An interlock system as recited in claim 4, wherein the lever for each latching module is removably mounted on its respective base and selectively pivotally connected to the base in a first position for use at one side of the drawer and in a second position for use at the opposite side of the drawer.

7. An interlock system as recited in claim 4, wherein the lever is pivoted at a first point on the base when the lever is in said first position and at a second point on the base when the lever is in said second position.

8. An interlock system as recited in claim 4, wherein said first and second points are on opposite sides of the second passageway.

9. An interlock system for a cabinet as recited in claim 1, wherein said cabinet has at least three drawers and a latching module for each drawer, said series of latching modules comprising an upper latching module, a lower latching module and at least one intermediate latching module, each of said upper and lower latching modules having a stop in a portion of the first passageway which extends away from said series of latching modules and a spring between the stop and the second transmitter which extends from the adjacent intermediate latching module, said springs constituting said biasing means.

10. An interlock system for a cabinet as recited in claim 1, wherein said system includes a locking module which is located above the uppermost latching module of said series of latching modules, said locking module having a locked state and an unlocked state and comprising:

(a) a third passageway along said first axis which has an opening facing said uppermost latching module, (b) an uppermost second transmitter which extends upwardly from said uppermost latching module to the locking module, (c) a first compression spring within said third passageway for biasing said uppermost second transmitter toward said uppermost latching module, said compression spring forming part of said biasing means, wherein the end surfaces of said second transmitters for each latching module are located at the inner opening of the second passageway for each latching module when the locking module is in its unlocked state, and (d) an actuator which includes a plunger which is in engagement with said spring and which is located in said third passageway for movement by said actuator toward and away from said uppermost second transmitter, wherein the changing of said locking module from the unlocked state to the locked state causes said plunger to move toward uppermost second transmitter for compressing said spring and thereby increasing the biasing effect of said spring when said locking module is in the locked state so that for each latching module, the end surfaces at the abutting ends of the second and third transmitter are shifted along said first axis away from the inner opening of the second passageway so that no of the drawers can be opened.

11. An interlock system for a cabinet as recited in claim 10, wherein the lowermost latching module in said series of latching modules comprises:

(a) a lowermost second transmitter which is located within the first passageway of said lowermost latching module and which extends downwardly from the inner opening of the second passageway of said lowermost latching module, (b) a stop at the lower end of the first passageway, and (c) a second compression spring which forms part of said biasing means and which is located between said stop and said lowermost second transmitter, said second compression spring being compressed by the increased biasing effect of said first compression spring when said locking module is in its locked state so that said first compression spring is compressed by said actuator.

12. An interlock system for a cabinet as recited in claim 1, wherein said cabinet has at least three drawers and a latching module for each drawer, said series of latching modules comprising an upper latching module, a lower latching module and at least one intermediate latching module comprising:

(a) a downwardly facing shoulder in the second transmitter which extends from the lowest intermediate latching module to said lower latching module, said shoulder being spaced from and facing said lower latching module, (b) a lower compression spring which extends between said shoulder and said lower latching module, (c) an upwardly facing shoulder in the second transmitter which extends from the uppermost intermediate latching module to said upper latching module, said upwardly facing shoulder being spaced from and facing said upper latching module, and (d) an upper compression spring which extends between said upwardly facing shoulder and said upper latching module.

13. An interlock system for a cabinet as recited in claim 12, wherein each of said lower and upper compression springs is a helical compression spring which is coiled about its respective transmitter.

* * * * *